US007261986B2

(12) United States Patent
Miskinis et al.

(10) Patent No.: US 7,261,986 B2
(45) Date of Patent: Aug. 28, 2007

(54) PHOTOCONDUCTIVE MEMBER FOR AN ELECTROPHOTOGRAPHIC MACHINE AND METHOD OF FORMING SAME

(75) Inventors: Edward T. Miskinis, Rochester, NY (US); Steven O. Cormier, West Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 208 days.

(21) Appl. No.: 10/836,756

(22) Filed: Apr. 30, 2004

(65) Prior Publication Data

US 2005/0244731 A1 Nov. 3, 2005

(51) Int. Cl.
*G03G 5/10* (2006.01)
*B05D 5/12* (2006.01)

(52) U.S. Cl. ..... 430/69; 430/127; 427/74

(58) Field of Classification Search ..... 430/69, 430/127, 62, 63; 427/74
See application file for complete search history.

(56) References Cited

U.S. PATENT DOCUMENTS

| | | | | |
|---|---|---|---|---|
| 3,914,126 | A * | 10/1975 | Pinsler | 430/62 |
| 4,283,248 | A * | 8/1981 | Kakuhashi et al. | 216/90 |
| 5,378,315 | A * | 1/1995 | Hendrix et al. | 216/92 |
| 5,403,627 | A * | 4/1995 | Wilbert et al. | 427/554 |
| 2001/0013473 | A1 * | 8/2001 | Taylor | 205/118 |

OTHER PUBLICATIONS

Accelerating Plating Cycles & Reducing Costs: Improving the Plating of High Aspect Ratio Holes & Blind Vias by James Taylor, presented at Photo Chemical Machining Institute on Mar. 26, 2002 and IPC Convention in Long Beach on Mar. 27, 2002.

* cited by examiner

*Primary Examiner*—John L Goodrow
(74) *Attorney, Agent, or Firm*—Lawrence P. Kessler; Carl F. Ruoff

(57) ABSTRACT

A method for producing a substrate for a photoconductive member includes etching the substrate with a self-limiting acid that removes the metal oxides from but does not affect the surface roughness of the substrate inner and outer surface.

6 Claims, 3 Drawing Sheets

PHOTOCONDUCTIVE MEMBER FOR AN ELECTROPHOTOGRAPHIC MACHINE AND METHOD OF FORMING SAME

CROSS-REFERENCE TO RELATED APPLICATION

Reference is made to the following commonly assigned application, the disclosure of which is incorporated herein by reference:

U.S. patent application Ser. No. 10/836,484, filed on Apr. 30, 2004, by Edward T. Miskinis, et al., entitled, "IMAGE CYLINDER SLEEVE FOR AN ELECTROPHOTOGRAPHIC MACHINE AND METHOD FOR PRODUCING SAME".

FIELD OF THE INVENTION

The present invention relates to photoconductive members for electrophotographic machines. More particularly, the present invention relates to a substrate for a photoconductive surface of a photoconductive member in an electrophotographic machine, and a method of producing same.

BACKGROUND OF THE INVENTION

Electrophotographic machines, such as, for example, copiers and printers, produce images by forming a latent image charge pattern on a photoconductive surface. The photoconductive surface carries the latent image through a developing station wherein pigmented toner particles are drawn by electrostatic attraction onto the latent image charge pattern on the photoconductive surface. An electric field is applied to transfer the image from the photoconductive surface onto either an intermediate transfer member or an image substrate, such as, for example, a piece of paper. Thereafter, the image is fixed, such as, for example, by fusing, to the image substrate.

In some electrophotographic machines, the photoconductive surface may be disposed upon a photoconductive member configured as an endless-loop belt having a photoconductive layer or surface. In other electrophotographic machines, the photoconductive surface is disposed on a photoconductive member configured as a cylindrical roller or drum, variously referred to as an image cylinder, photoconductive drum or photoconductive roller. Generally, the photoconductive drum includes an inner roller or mandrel over which a photoconductive sleeve is disposed. The mandrel is typically constructed of aluminum. The photoconductive sleeve is typically constructed from a metal substrate, such as, for example, nickel, onto which several layers of material, including a photoconductive layer, are disposed.

The substrates are typically formed by electroplating, and initially have a very smooth inside and outside surface. In fact, the surfaces are so smooth that an acid etching process is conventionally used to improve adhesion of the photoconductive and/or other layers to the substrate. The acid etching process removes metal oxides from the substrates and thereby desirably increases adhesion of materials to and increases the conductivity of the substrate. However, the acid etching process may increase the surface roughness of the inside and/or outside surfaces of the substrate to an undesirable degree. A substrate having an outer surface that is too rough or which has a roughness in excess of a certain limit can cause the thickness of the photoconductive layer disposed thereon to vary and cause localized differences in the response of the layer to the charging and exposing processes which, in turn, may result in undesirable image artifacts appearing on the image substrate. A substrate having an inside surface that is too rough or which has a roughness in excess of a certain limit may render the photoconductive sleeve less compatible with the air-mounting process by which the sleeves are typically mounted onto a drum or mandrel to thereby assemble the photoconductive drum.

Moreover, acid etching processes are generally not self-limiting and therefore significant process variation can occur. More particularly, the amount of etching that occurs is dependent at least in part upon the concentration of the acid bath, temperature of the bath, time in the bath, and the microcomposition of the nickel substrate. The process variation occurs not only between substrates, i.e., from one substrate to another, but also occurs within a single substrate.

Therefore, what is needed in the art is an improved acid etching process for preparing the surfaces of a substrate to be used as the photoconductive surface of the photoconductive drum in electrophotographic machine.

SUMMARY OF THE INVENTION

The present invention provides a method for producing a substrate for a photoconductive surface of a photoconductive member in an electrophotographic machine.

The present invention includes, in one form thereof, the process of etching the substrate for the photoconductive member with a self-limiting acid that removes the metal oxides from but does not affect the surface roughness of the substrate surface.

An advantage of the present invention is that the etching process is self limiting and does not undesirably affect the surface roughness of the substrate inner or outer surface.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
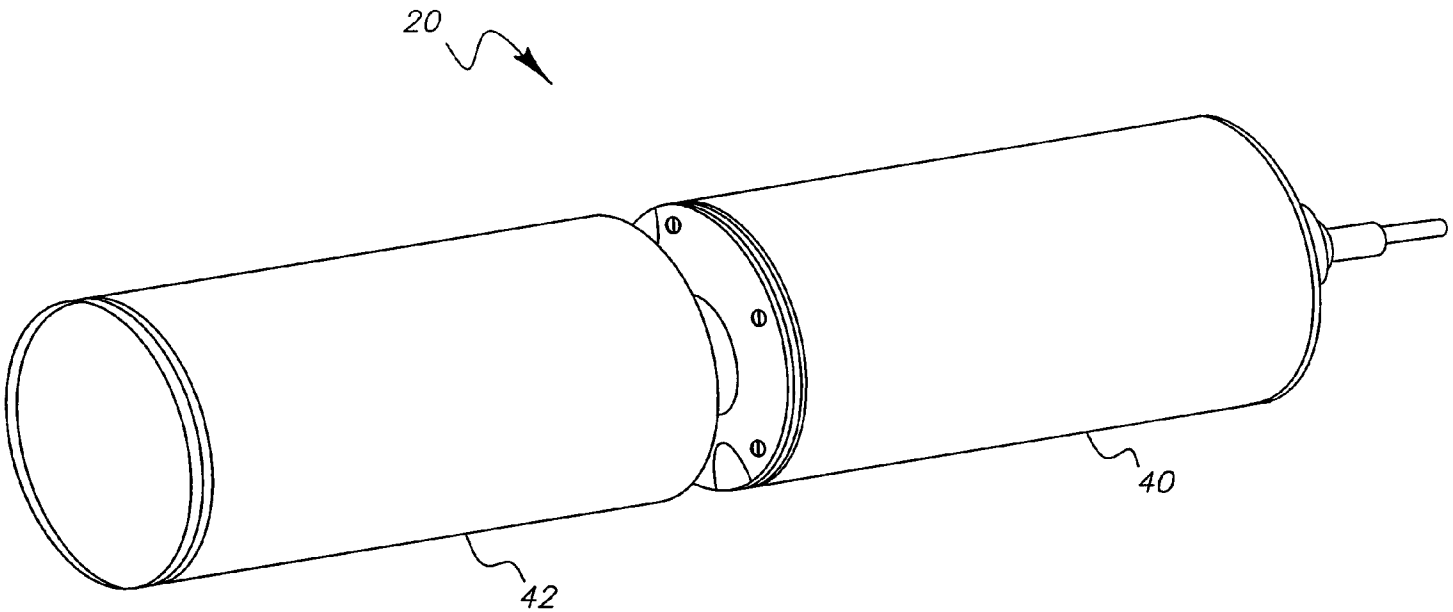
FIG. 1 is an exploded view of a photoconductive drum.

Referring to FIG. 1, an exploded view of a photoconductive drum 20 is shown. Photoconductive drum 20 includes inner roller or mandrel 40 and an outer photoconductive sleeve 42. Mandrel 40 is typically constructed of metal, such as, for example, aluminum, and has a hard outer surface (not referenced) that is machined to a very smooth surface finish, such as, for example, by turning and/or polishing.

Figure 2:
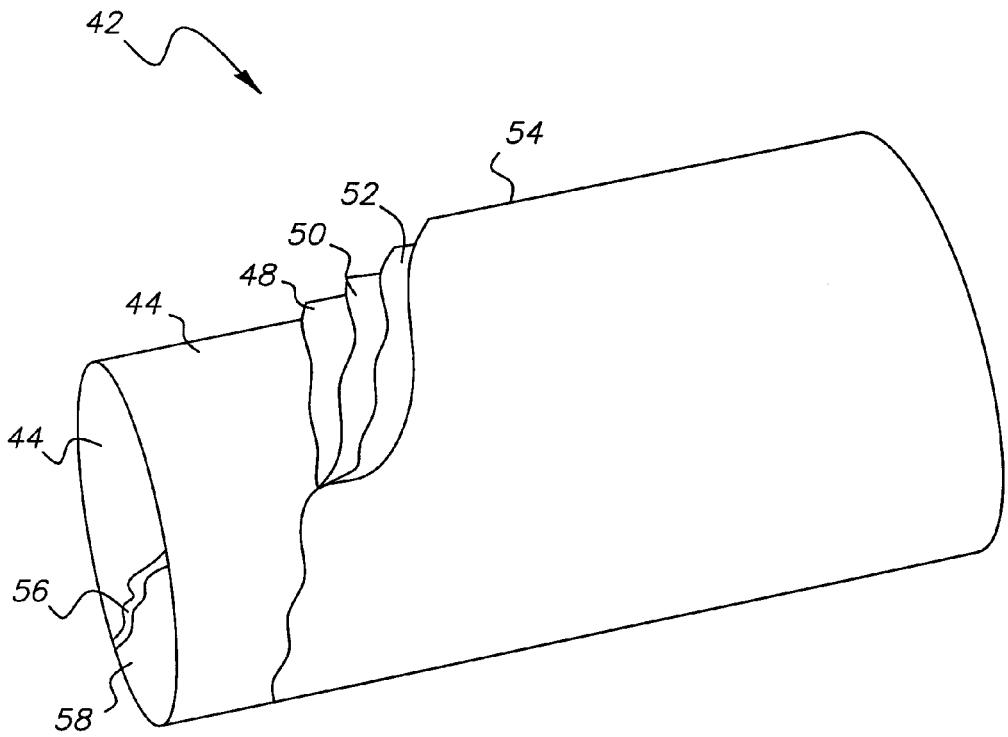
FIG. 2 is a partially-sectioned cut away view of the photoconductive sleeve of FIG. 1.

Photoconductive sleeve 42, as best shown in FIG. 2, includes a substrate 44 and one or more overlying layers of material. More particularly, photoconductive sleeve includes outer smoothing layer 48, outer barrier layer 50, charge generating layer 52, charge transport layer 54, inner smoothing layer 56 and inner barrier layer 58, each of which are disposed upon and/or over substrate 44. Photoconductive sleeve 42 is disposed upon and surrounds at least a portion of the outer surface of mandrel 40. Typically, photoconductive sleeve 42 is mounted onto mandrel 40 by an air-mounting process, and an interference fit exists or is formed therebetween. Substrate 44 is constructed of metal, such as, for example, nickel.

Generally, and as is known in the art, air mounting photoconductive sleeve 42 upon mandrel 40 involves connecting a supply of pressurized air to an air inlet of the mandrel 40. The mandrel 40 is constructed such that the pressurized air is channeled into a clearance formed between a nose piece thereof, a chambered portion of the main body of the mandrel, and the inside surface (not referenced) of photoconductive sleeve 42. The pressurized air causes photoconductive sleeve 42 to temporarily expand and/or deflect outward, thereby forming a gap between the outer surface of the mandrel body and the inside surface of sleeve 42 which facilitates the sliding of photoconductive sleeve 42 over and onto the mandrel body. When the photoconductive sleeve 42 is in the desired position over the mandrel body, the air pressure supplied to mandrel 40 is removed and photoconductive sleeve 42 returns to its normal and undeflected inside diameter. An interference fit is thereby formed between the inside surface of photoconductive sleeve 42 and the outer surface of the mandrel body.

The process of air mounting is particularly sensitive to the characteristics of the inside surface of photoconductive sleeve 42. More particularly, in order to facilitate the air mounting process, the inside surface of photoconductive sleeve 42 must be relatively smooth. The smooth inside surface lowers insertion force, i.e., the force required to slide photoconductive sleeve 42 over or relative to mandrel 40. In order to be compatible with the air mounting process, the inside roughness of photoconductive sleeve 42 is preferably less than approximately 1.0 microns (μ) roughness average and less than approximately 2.0μ roughness peak-to-peak, and more preferably from approximately 0.5μ to approximately 0.20μ roughness average and from approximately 1.5μ to approximately 0.5μ roughness peak-to-peak. However, photoconductive sleeves typically have an inside roughness of approximately 0.5μ roughness average and approximately 3.0μ roughness peak-to-peak due to the substrates of the photoconductive sleeves having been cleaned of metal oxides by an acid etching process as described above.

Smoothing the inside surface of substrate 44 by conventional processes such as, for example, grinding or polishing, may be somewhat more difficult, time consuming, and costly. Further, the process or processes that are used to smooth the inside surface of substrate 44 must not affect or roughen the outside surface of substrate 44 for the reasons described above. Conventional acid etching processes used to remove metal oxides from substrate 44, as described above, are not self-limiting and increase the roughness of the inside and outside surfaces of the substrate. Conversely, the process of the present invention is self-limiting and does not undesirably increase the roughness of the inside and/or outside surfaces of substrate 44.

Figure 3:
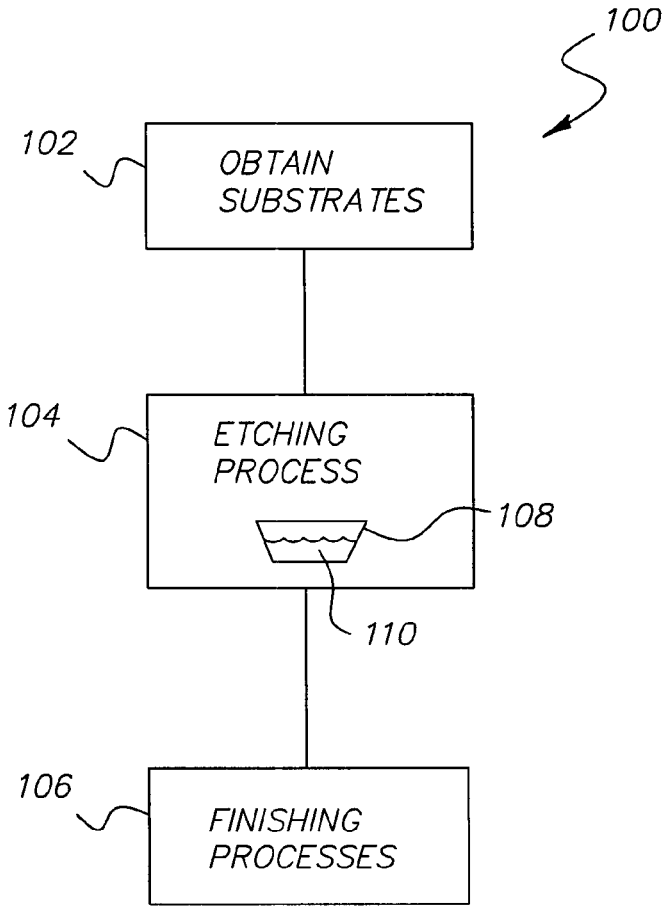
FIG. 3 is a diagram of one embodiment of a method of the present invention for producing a substrate for a photoconductive drum.

Referring now to FIG. 3, there is shown one embodiment of a method of the present invention for producing a substrate for a photoconductive drum. Process 100 includes obtaining substrates 102, etching process 104 and finishing processes 106.

Obtaining substrates 102 generally includes obtaining, such as, for example, by producing or purchasing, substrates 44 that conform to predetermined specifications and which are suitable for use as photoconductive sleeves 42 on photoconductive drums 20. In this exemplary embodiment, substrates 44 are constructed of substantially pure nickel.

Etching process 104 includes etching substrates from process 102 by exposing the surfaces of the substrates to an acid etch that is self-limiting and which removes metal oxides from the surfaces of the substrate but does not substantially affect the surface finish or roughness of the substrates. More particularly, etching process 104 immerses, such as, for example, by dipping, the substrates in an acid bath 108. Acid bath 108 contains a self-limiting acid 110, such as, for example, an acid including from approximately thirteen to approximately seventeen percent of Hydrochloric acid and from approximately two to approximately three percent Sulfuric acid with an organic polymer component/stabilizer. Such an acid bath preparation is commercially available from Duratech Industries of Jamestown, N.Dak., under the name Duraprep ssp 1000™. The acids etch the substrate and remove metal oxides form the surface thereof. When the metal oxides are removed and the surface of the substrate exposed, a dense hydrophobic layer is formed on the metallic surface that reduces the resistance of the metal. The hydrophobic layer sheds rinse water and prevents the formation of oxides during the final acidic activation step before plating.

Etching process 104 is self-limited such that process 104 ceases when the metal oxides have been removed from the substrate surfaces. The surface roughness of the substrate is thus substantially unaffected by etching process 104. Following etching process 104, the etched substrates have surfaces that are highly conductive and to which polymers, such as used in the formation of the smoothing and barrier layers, readily adhere. Further, etching process 104 is highly repeatable from substrate to substrate and significantly reduces variation within individual substrates.

Finishing processes 106 includes various processes, such as, for example, forming one or more of outer smoothing layer 48, outer barrier layer 50, charge generating layer 52, charge transport layer 54, inner smoothing layer 56 and inner barrier layer 58 upon and/or over substrate 44.

While this invention has been described as having a preferred arrangement, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

20. Photoconductive member or drum
40. Mandrel
42. Photoconductive Sleeve
44. Substrate
48. Outer Smoothing Layer
50. Outer Barrier Layer
52. Charge Generating Layer

54. Charge Transport Layer
56. Inner Smoothing Layer
58. Inner Barrier Layer
100. Process
102. Obtain Substrates
104. Etching Process
106. Finishing Process
108. Acid Bath
110. Self-limiting acid

What is claimed is:

1. A method for producing a substrate for a photoconductive member, comprising:

obtaining at least one substrate; and etching with a self-limiting acid the at least one substrate wherein the self-limiting acid consists essentially of from approximately thirteen to approximately seventeen percent hydrochloric acid, from approximately two to approximately three percent sulfuric acid, and an organic stabilizer.

2. The method of claim 1, wherein the at least one substrate is comprised substantially entirely of nickel.

3. The method of claim 2, wherein said etching process comprises exposing the at least one substrate to the self-limiting acid.

4. The method of claim 3, wherein said etching process comprises dipping the at least one substrate in an acid bath, the acid bath including the self-limiting acid.

5. The method of claim 3 further comprising the further process of finishing the substrate, said finishing process comprising at least one of applying an inner smoothing layer, an outer smoothing layer, an inner barrier layer, an outer barrier layer, a charge generating layer and a charge transport layer.

6. A substrate for a photoconductive member comprising:

at least one substrate; and said at least one substrate being etched with a self-limiting acid consists essentially of from approximately thirteen to approximately seventeen percent hydrochloric acid, from approximately two to approximately three percent sulfuric acid, and an organic stabilizer.

* * * * *